US008381542B2

(12) United States Patent
Afolabi

(10) Patent No.: US 8,381,542 B2
(45) Date of Patent: Feb. 26, 2013

(54) BEVERAGE TEMPERATURE MODIFICATION DEVICE

(76) Inventor: Oluwafemi Ajibola Afolabi, Mississauga (CA)

( * ) Notice: Subject to any disclaimer, the term of this patent is extended or adjusted under 35 U.S.C. 154(b) by 549 days.

(21) Appl. No.: 12/485,875

(22) Filed: Jun. 16, 2009

(65) Prior Publication Data

US 2009/0277211 A1 Nov. 12, 2009

Related U.S. Application Data

(63) Continuation-in-part of application No. 11/286,977, filed on Nov. 28, 2005, now abandoned.

(51) Int. Cl.
*F25D 3/08* (2006.01)

(52) U.S. Cl. ..... 62/457.3

(58) Field of Classification Search ..... 62/457.1, 62/457.2, 457.3, 457.4, 457.9, 304
See application file for complete search history.

(56) References Cited

U.S. PATENT DOCUMENTS 5,653,124 A * 8/1997 Weber ..... 62/457.4
5,732,567 A * 3/1998 Anderson ..... 62/457.4
2007/0277547 A1* 12/2007 Veeravagu et al. ..... 62/396

* cited by examiner

*Primary Examiner* — Melvin Jones

(57) ABSTRACT

A beverage temperature modification device for cooling and warming beverages in a drinking vessel. The device has a body with an interior chamber for holding a temperature modifying substance such as water and a cap with an arm for securing the device to the rim of a vessel so that the device is maintained in a fixed position. The cap may be detachable and the body may have an opening for putting the temperature modifying substance into the chamber, or the temperature modifying substance may be sealed permanently in the chamber. The arm may be flexible so that it can stretch to allow securing the device to rims varying in thickness by a factor of two or more. The arm may be pivotable to allow adjustment of the position of the device when it is secured to the rim of a vessel.

19 Claims, 10 Drawing Sheets

BEVERAGE TEMPERATURE MODIFICATION DEVICE

CROSS-REFERENCE TO RELATED APPLICATION

This application is a continuation-in-part of co-pending U.S. patent application Ser. No. 11/286,977 filed Nov. 28, 2005, which is incorporated herein by reference in its entirety for all purposes.

FIELD OF THE INVENTION

The present invention relates generally to devices for modifying the temperature of beverages, and more particularly devices that attach to drinking vessels for modifying the temperature of beverages.

BACKGROUND OF THE INVENTION

Many methods and devices have been disclosed to cool and heat beverages in drinking vessels. For cooling, the most common method is to place ice directly in the beverage. This approach suffers from the problem that the ice dilutes the beverage as it melts. Also the quality of the water used to make ice may also be a health concern, when the melted ice is consumed along with the beverage. The free-floating characteristic of ice may inconvenience drinkers, or users, attempting to avoid consumption of the ice along with the beverage. The ice can become a choking hazard when swallowed.

An alternate approach that has been disclosed is to wrap a cooling material around a drinking vessel. However, this distorts the exterior shape of the vessel and creates an inconvenience in handling the vessel. Also, there is usually a significant delay in obtaining a cold beverage because the cooling material is not in direct fluid contact, which slows down the heat transfer or absorption process.

Some devices have been disclosed for direct placement in a beverage where the device contains a heating or cooling material, such as ice, thus avoiding the problems of diluting the beverage and of introducing unsanitary fluid into the beverage. In most cases these are large devices designed to attach to pitchers of beverages either by resting against the wall of the pitcher or by the use of a clip. Others that may be suitable for inserting into a drinking vessel employ flexible material for holding the cooling material, which can thereby move around inside the vessel, with a clip to attach the device to the vessel.

The clips used in such devices are generally plastic clips that pivot around a point that connects to the unit containing the cooling material. The pivot point contacts the rim of the vessel with the clip extending down the side of the vessel to apply pressure to it and retain the unit near the side of the vessel. Such an approach has several drawbacks. For cost reasons, the clip is generally made of plastic and is thereby prone to breaking after many uses, particularly when used to attach the unit to a vessel with a rim that is thicker than it was designed for. They may also be unable to provide a secure connection to a variety of rim thicknesses. They also extend down the outside side of the glass for a sufficient distance that the person using the vessel may contact the clip while using the vessel. Also the position of the unit inside the vessel relative to the side of the vessel cannot be controlled by the user.

SUMMARY OF THE INVENTION

The invention relates to device for modifying the temperature of a beverage in a vessel having a rim, the device comprising a. a hollow rigid body having side walls and top and bottom ends defining an interior chamber for retaining a temperature modifying substance that has been pre-cooled or pre-heated to change the temperature of the beverage when placed in indirect contact with the beverage and b. a cap attached to the top end of the body, the cap having a main portion and an arm extending first laterally away from the body and then downward so that the distance between the downward portion of the arm and the main portion of the cap is less than or equal to the thickness of the rim of the vessel for frictionally and detachably securing the device to the rim of the vessel to retain at least a portion of the body inside the vessel in a fixed position, wherein the temperature modifying substance is in thermal communication with the beverage for exchanging heat with the beverage.

The arm may be made of a flexible material that may be stretched thereby increasing the width of the notch so that the device may be securely attached to vessels having rim thicknesses that vary by at least a factor of two.

The device may further include a positioning means, or straw holder, for holding a drinking straw.

In one embodiment, the body includes an opening in its top end for receiving the temperature modifying substance into the chamber and the cap is detachable and sealingly engagable with the opening.

In another embodiment, the arm is pivotable about an axis extending from the top end to the bottom end of the body for varying the position of the device within the vessel when the device is secured to the rim of the vessel.

In other embodiments, the device may be weighted so as to maintain the bottom end below the top end and maintaining the body submerged in the beverage whether or not the device is secured to the rim of the vessel.

Other features of the invention will be evident from the disclosure of several embodiments that follows.

In another embodiment, the invention is referred to as a modified releaser. This invention describes a hollow device (modified Releaser) with multiple functions, made from a metal, plastic or rubber material. The releaser can be used for removing frozen shapes in a freezer tray (previously described in U.S. Pat. No. 6,540,200). When water is added into its reservoir and frozen, the modified releaser may also be used to cool beverages. This additional cooling function takes place when the pre-cooled modified releaser is attached to a vessel containing the beverage. A technique that takes advantage of the unique reservoir shape separates the melted ice (or water) from the frozen ice in the initial cooling stage, thereby increasing the cooling effectiveness. Also by suspending the solid ice formation in the reservoir and allowing the resulting water an easy passage to the bottom portion of the modified releaser, this technique effectively contains the water in the modified releaser during the initial cooling stage. This prevents spillage, or mixing of the water and beverage.

A design feature shaped as a hook permits the attachment of the modified releaser to the inside of vessels such as cups. Another feature, a hollow cylindrical shape which resembles a ring, permits the insertion of a straw through its middle section. The function of this ring-like feature is to hold the object within its center in place.

The top portion of the modified releaser has an open end which exposes the reservoir. When water is added into the reservoir and frozen, the top opening allows easy monitoring of the ice. This visual monitoring provides a real time means of determining the cooling potential of the modified releaser. The cooling effectiveness of the modified releaser diminishes as more ice becomes water which flows to the vacant lower compartment of the reservoir. Initially a reduction in the ice level is observed through the top opening. As the cooling capacity declines further, the increasing water volume serves as the principal indicator.

BRIEF DESCRIPTION OF THE DRAWINGS

The present invention will now be described by way of example with reference to the following drawings in which.

DETAILED DESCRIPTION OF THE INVENTION

Figure 1:
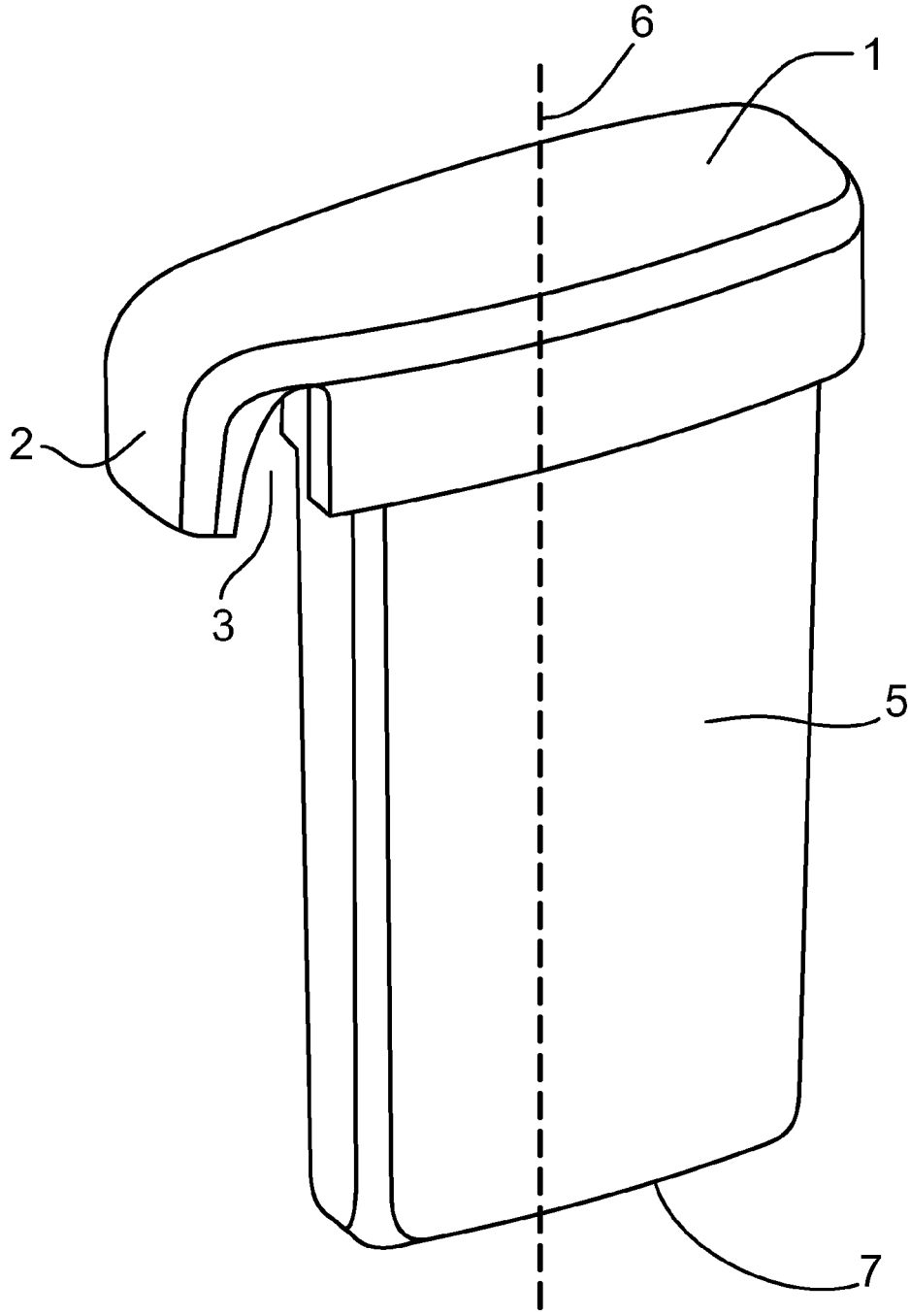
FIG. 1 is a perspective view of the device with the cap attached to the body.

In a preferred embodiment shown in FIG. 1, the device comprises a cap 1 and a body 5. The body 5 may be made of a rigid material such as plastic or metal. The cap 1 and body 5 are made from food grade materials since they are placed in direct contact with a beverage being consumed. The body 5 is hollow and has side walls, a top end corresponding to the location of the cap 1 and a bottom end 7, defining an interior chamber. The interior chamber is designed to hold a temperature modifying substance. The temperature modifying substance may be permanently sealed in and part of the device, or may be added via an opening in the top end of the body 5. The cap 1 may be integrally formed with the body 5, may be otherwise attached to the body 5, or may be detachable from the body 5. If the cap 1 is not detachable from the body 5, it may have an opening with a removable lid whereby temperature modifying substance may be added though the opening when the lid is not in place.

Various substances may be used as a temperature modifying substance such as water or water with additives to modify its freezing or boiling point. An antifreeze, such as alcohol, and a gel substance may be added to water. A freezing gel may be used, such as hydroxyethyl cellulose. A one-time cooling device could employ, for example, water and ammonium nitrate in separate compartments in the body 5 that can be mixed by bending or squeezing the body 5 to cause an endothermic reaction prior to using the device to cool a beverage.

Figure 3:
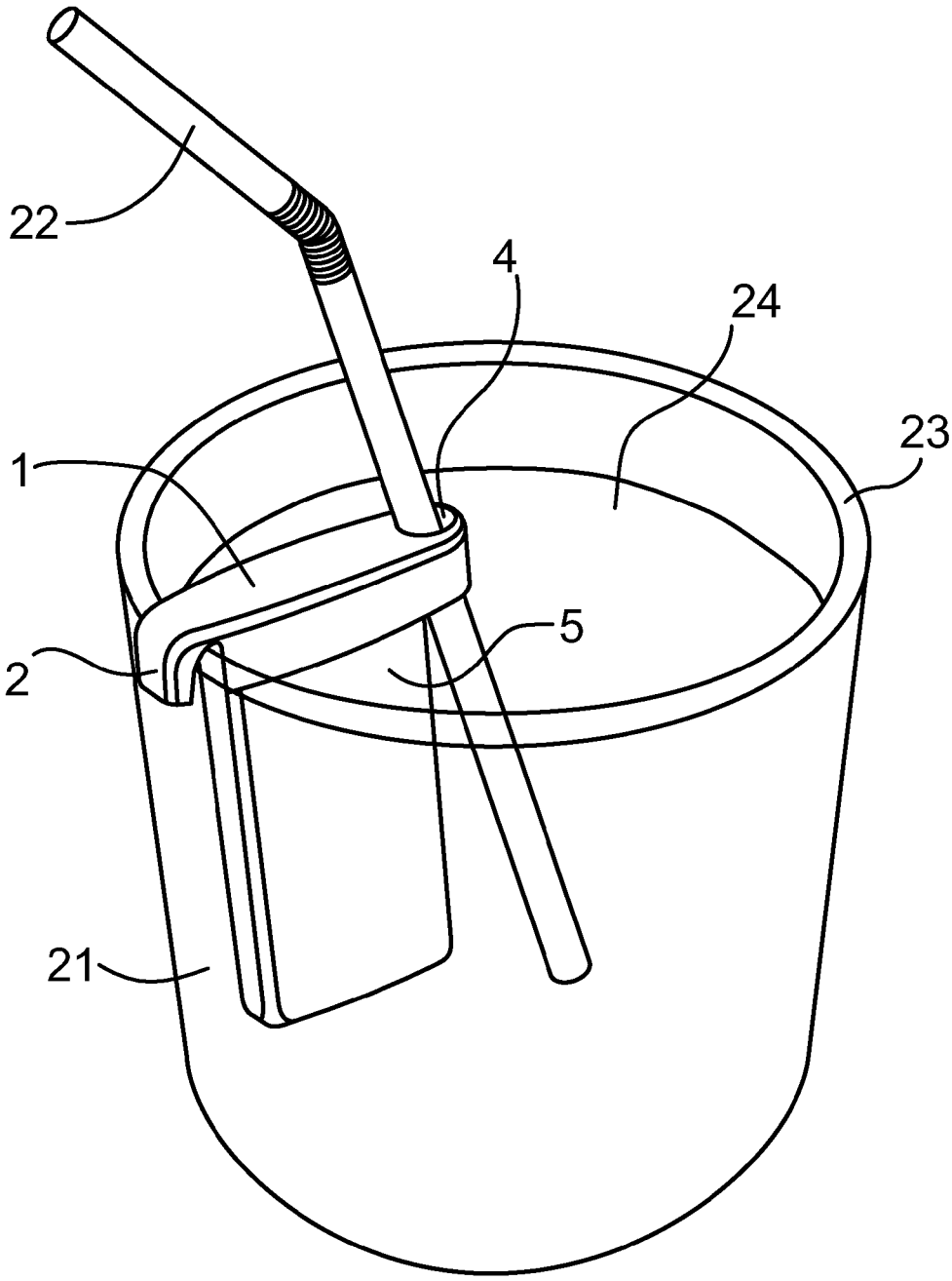
FIG. 3 is a perspective view of the device secured to the rim of a vessel.

The cap 1 has a main portion with an arm 2 protruding therefrom, shaped so as to define a notch 3 having a defined width. The arm 2 may extend first laterally outward and then bend or curve downward towards the bottom end 7 of the body 5. The initial lateral extension may be approximately perpendicular to the central axis 6 and the downward portion may be approximately parallel to the central axis 6. The arm 2 and main portion of the cap 1 may thereby form an inverted "U" shaped notch 3 as shown in FIG. 1. The width of the notch 3 is equal to the distance between the downward portion of the arm 2 and the main portion of the cap 1. The arm 2 may be integrally formed with the cap 1, or may be otherwise attached thereto. The device may be secured to the inside of a drinking vessel 21, such as a cup or a wine glass, as shown in FIG. 3, by placing the notch 3 over the rim 23 of the vessel 21. A secure attachment is achieved by frictional engagement of the notch 3 with the rim 23 when the width of the notch 3 equals the width of the rim 23 of the vessel 21 so as to maintain the device inside the vessel 21 in a fixed position. The position of the device remains fixed relative to the vessel 21, even if the orientation of the vessel 21 is changed, because of the secure attachment with the rim 23 and the fact that the body 5 is made of a rigid material. Because the width of the notch 3 equals the width of the rim 23 of the vessel 21, the arm 2 may be relatively short and does not need to extend down the outer surface of the vessel 21 for a significant distance, while still providing a secure attachment.

The arm 2 may be made of a flexible material, such as silicone rubber, so that it can be stretched outward, away from the body 5, to increase the width of the notch 3 by up to 1.5, 2 or more times the width of the notch 3 in an unstretched configuration. This allows one instance of the device to be securely attached to vessels 21 having rim 23 thicknesses that vary by a factor of 1.5, 2, or more. When the device is secured to a rim 23 having a thickness greater than the minimum rim thickness corresponding to the width of the notch 3 in an unstretched configuration, the strength of the frictional engagement of the notch 3 with the rim 23 is increased and the device is more securely attached than it would be to a rim 23 of minimum rim thickness. It is therefore preferred that the width of the notch 3 be somewhat less than the thickness of the rim 23 of a vessel 21 to which it will be secured.

The temperature of the temperature modifying substance may be modified to a temperature different from the temperature of a beverage 24 by placing the device, with the temperature modifying substance in its interior chamber, into a heating device, such as a microwave oven, or into a cooling device, such as a freezer. Alternatively, in an embodiment with a removable cap 1, pre-heated or pre-cooled temperature modifying substance may be placed into the internal chamber of the body 5. When the temperature modifying substance is water it will normally freeze into solid form (as ice) in a freezer. When the device is then attached to the rim 23 of a vessel 21 containing a beverage 24, as shown in FIG. 3, the temperature modifying substance is then in indirect contact, and in thermal communication, with the beverage 24 and heat will be exchanged between the beverage 24 and the temperature modifying substance so that the temperature of the beverage 24 will be changed. The beverage will be cooled if the temperature modifying substance was cooled below the temperature of the beverage 24, or heated if the temperature modifying substance was heated to a temperature greater than the temperature of the beverage 24. In some embodiments, the body 5 is made of a translucent or transparent material, such as clear plastic, so that the state of the temperature modifying substance can be observed through the walls of the body 5. For example, when water is used as the temperature modifying substance and it is cooled into ice, the user can observe how much of the ice has melted and may choose to replace the device with another device that contains ice when the ice in the first device has returned to liquid form. This may be repeated multiple times without any dilution of the beverage 24.

As shown in FIG. 3, the device may further include a positioning means, or straw holder 4, for maintaining a drinking straw 22 in fluid communication with the beverage so that the user can drink the beverage 24 through the straw 22. The straw holder 4 may be a ring or cylinder with an opening sufficiently large to accommodate commonly used drinking straws 22. The straw holder 4 may be attached to the body 5 or may be attached to the cap 1 as shown in FIG. 3. In the latter case, the straw holder 4 may be integrally formed with the cap 1.

Figure 2:
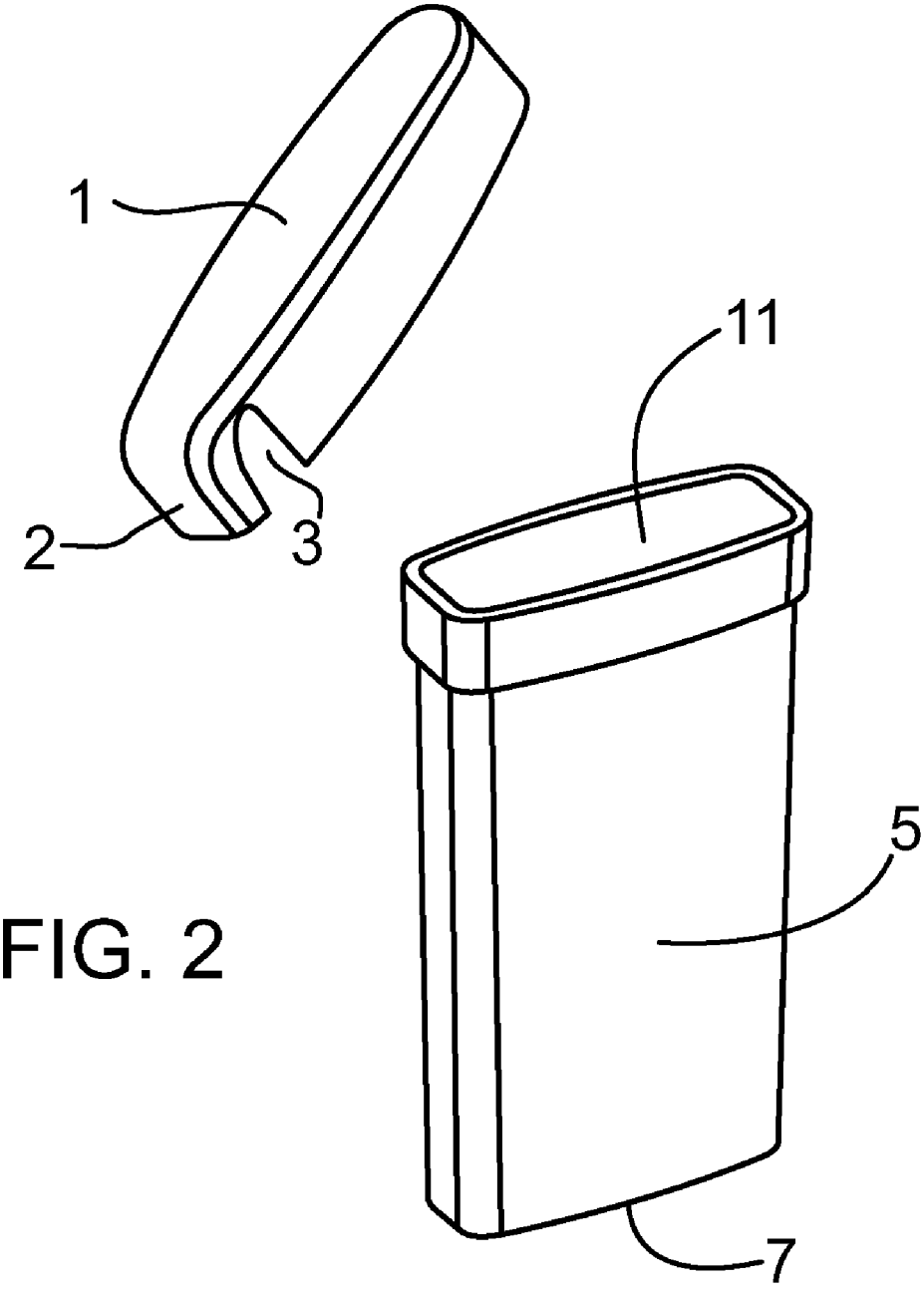
FIG. 2 is a perspective view of the device with the cap detached from the body.

The cap 1 may be detachable from the body 5, as shown in FIG. 2. in this case, the body may have an opening 11 to the interior chamber in the top end through which a user may add temperature modifying substance such as water, and the cap 1 is sealingly engageable with the body 5. This may be effected by the cap 1 having side walls corresponding to the outer dimensions of the walls of the body 5 so that the cap 1 can be retained on the body 5 by friction by sliding the side walls of the cap 1 over the top end of the body 5 as shown in FIG. 1. The cap 1 may also have a protrusion or bump, which may be inflated, corresponding to the size of the opening 11 whereby the protrusion extends into the opening 11 when the cap 1 is engaged with the body 5 so as to seal the opening 11 and prevent temperature modifying substance from leaving the interior chamber. The cap 1 may be made of a flexible material, such as silicone rubber, to facilitate creating a good seal with the opening 11.

The device may be used to cool or heat the beverage 24 either by securing it to the rim 23 of a vessel 21, or by placing the device directly into the beverage 24 without securing it to the rim 23. The body 5 is retained so that at least a portion of the body 5 is submerged in the beverage 24, and so that most of the body 5 is submerged in the beverage 24 when the vessel 21 is filled with the beverage 24. The device may be designed so that it has a density similar to or somewhat less than that of water so that by placing material, such as metal or pebbles, that is denser than water into the interior chamber, which extends to near the bottom end of the body 5, the device may be maintained in an upright position with the top end above the bottom end 7. The central axis 6 extending from the top end to the bottom end 7 of the body 5 is thereby maintained in a substantially vertical orientation when the body 5 is submerged in a beverage 24. For such use, the device may be designed to have a thin profile with an elongated body 5 where the distance between the top end and bottom end 7 along the vertical axis 6 exceeds, and may be two times or more, the width of the body 5 in any plane perpendicular to the central axis 6. The cross-section of the body 5 in any plane perpendicular to the central axis 6 may be circular, oval, or polygonal or some combination thereof. A rectangular or oval cross-section is preferred to provide a greater ratio of surface area to volume so as to increase the heat exchange rate as compared to a device with a circular cross-section.

The device may be constructed with a thin profile such that the bottom end 7 is denser than water and is also denser than the average density of the device, where the average density of the device is approximately equal to or somewhat greater than the density of water for maintaining the bottom end 7 below the top end and maintaining the body 5 submerged in the beverage 24. By making the density of the bottom end 7 sufficiently great, the device may be maintained with the central axis 6 in a substantially vertical orientation so that the device free floats in a vertical orientation when the device is not attached to the vessel 21. This may be achieved, for example, by making the body 5 out of plastic and embedding, or otherwise attaching, a sufficiently large piece of metal or other dense material in the bottom end 7. When the device has a thin profile it may float freely in the beverage without being overly intrusive to the user while consuming the beverage 24.

The device may be placed in contact with the beverage 24 for a period in order to cool or warm the beverage 24 and then removed prior to consumption of the beverage 24, or it may be left in contact with the beverage 24 while it is being consumed, either secured to the rim 23, or free floating in the beverage 24.

Figure 4:
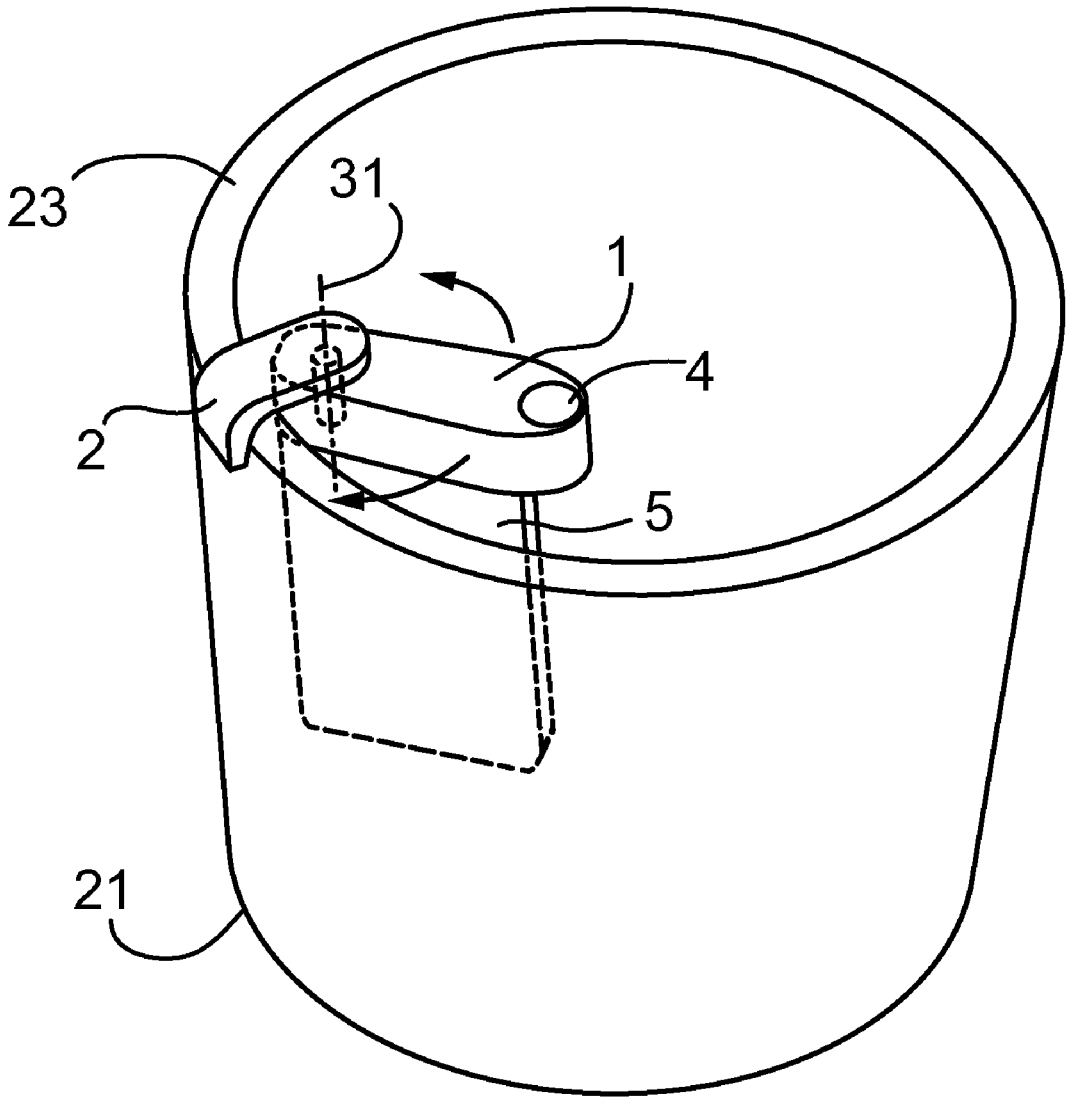
FIG. 4 is a perspective view of the device secured to the rim of a vessel in a pivoted position.

In another embodiment as shown in FIG. 4, the arm 1 may be pivotable about a vertical axis 31 extending from the top end to the bottom end 7 of the body 5 for varying the position of the device within the vessel 21 when the device is secured to the rim 23 of the vessel 21. This permits, for example, a thin profile version of the device, having a relatively small width, as does the embodiment shown in FIG. 4, to be pivoted so that the body 5 and straw holder 4 are maintained closer to the wall of the vessel 21, which may be more convenient for drinking the beverage 24 with or without the use of a straw 22, and may also allow more efficient positioning of multiple devices when attached to the rim of a storage container. The arm 2 may be made pivotable by various means. For example, the arm 2 and cap 1 may be integrally formed from a flexible substance that maintains the position of the arm 2 when it is moved into a pivoted position. Alternatively, the arm 2 and cap 1 may be integrally formed of a flexible material such as rubber with a piece of metal extending from the main part of the cap 1 into the arm whereby the metal retains its shape when bent and maintains the arm 2 in a pivoted position. Alternatively, the arm 2 may be connected to the main part of the cap 1 by having a threaded portion that is received into a threaded hole in the top of the cap 1 which permits the arm 2 to pivot. In a simpler embodiment, a protrusion on the arm may frictionally engage a hole in the cap 1 running along the vertical axis 31.

Figure 5:
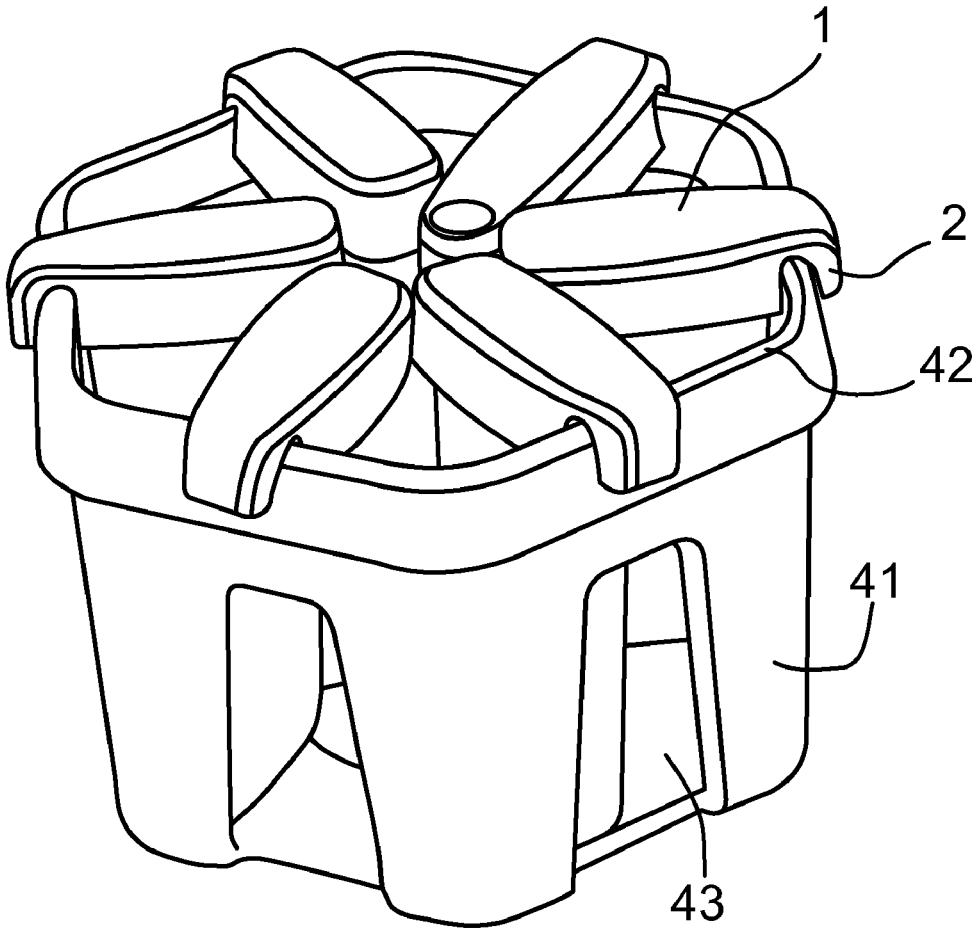
FIG. 5 is a perspective view of a hexagonal storage container with multiple devices attached.

The invention may further include a storage container 41, or freezer rack, as shown in FIG. 5 having a rim 42 for retaining the devices. The storage container 41 may have a cross-section that is circular, oval or polygonal, such as the hexagonal shape shown in FIG. 5. The storage container 41 permits a user to conveniently store multiple devices. When temperature modifying substance is contained in each device, the storage container 41 may be placed in a freezer to cool all the devices simultaneously so that the multiple devices are all ready for use to cool a beverage 24. The storage container 41 may have openings 43 in some or all the sides in order to facilitate the flow of cold air and may or may not have a bottom portion. The bottom portion may have one or more holes to facilitate drainage. The height of the walls of the storage container 41 is approximately equal to or greater than the length of the device along its central axis 6 so that the devices can be maintained in a vertical position when secured to the storage container 41 as shown in FIG. 5.

In other embodiments, the invention is a multi-use device referred to as a modified releaser. The modified releaser is a dual function plastic device that is primarily used to remove frozen ice shapes from inserts. This function has been described in U.S. Pat. No. 6,540,200. In this invention, the body of the modified releaser is adapted to become a reservoir. A coolant that solidifies when frozen is added into the reservoir. As a result, the modified releaser may be utilized directly to cool beverages in drinking vessels.

Figure 6:
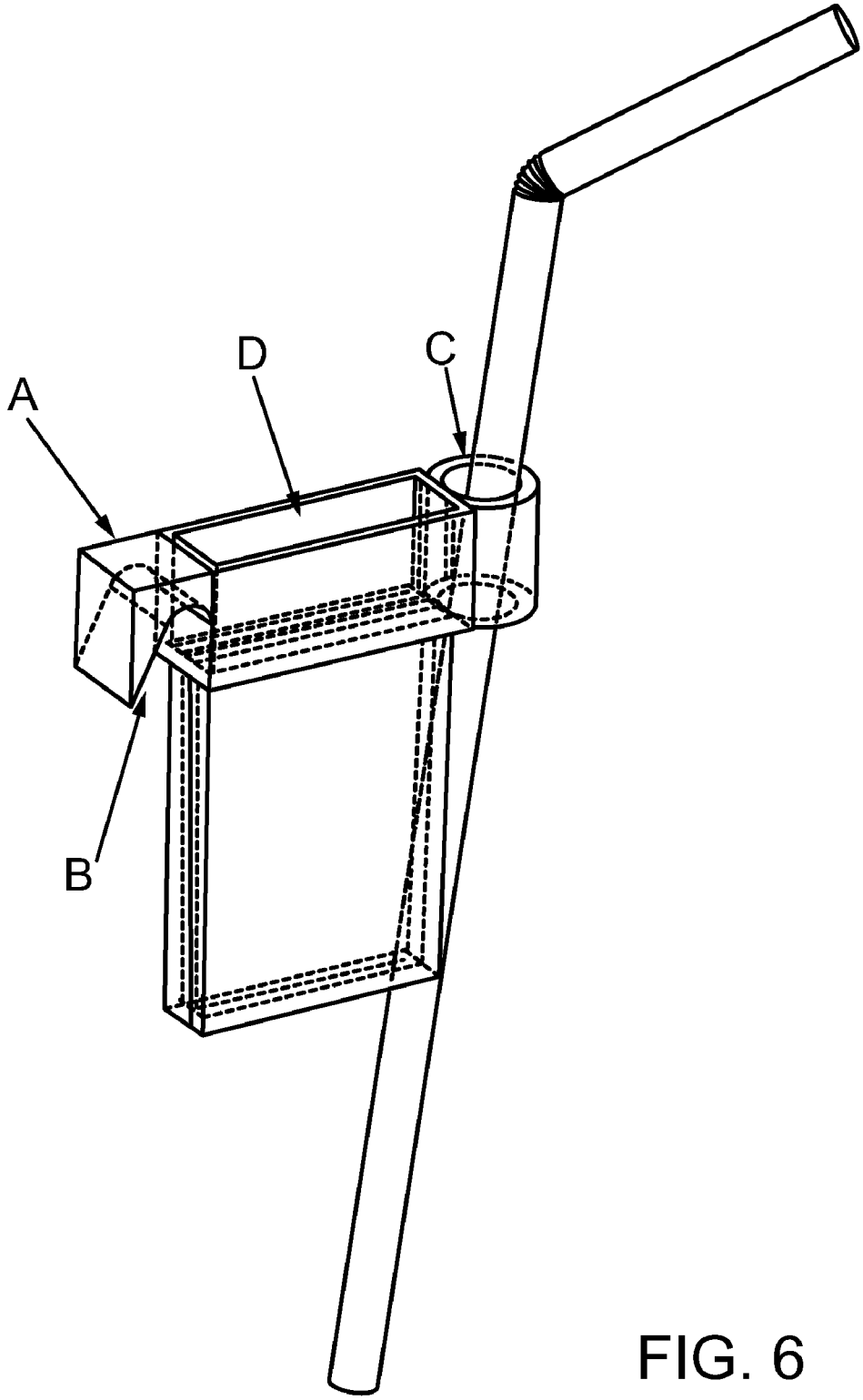
FIG. 6 is a perspective view of an embodiment of the invention referred to as a modified releaser.
Figure 7:
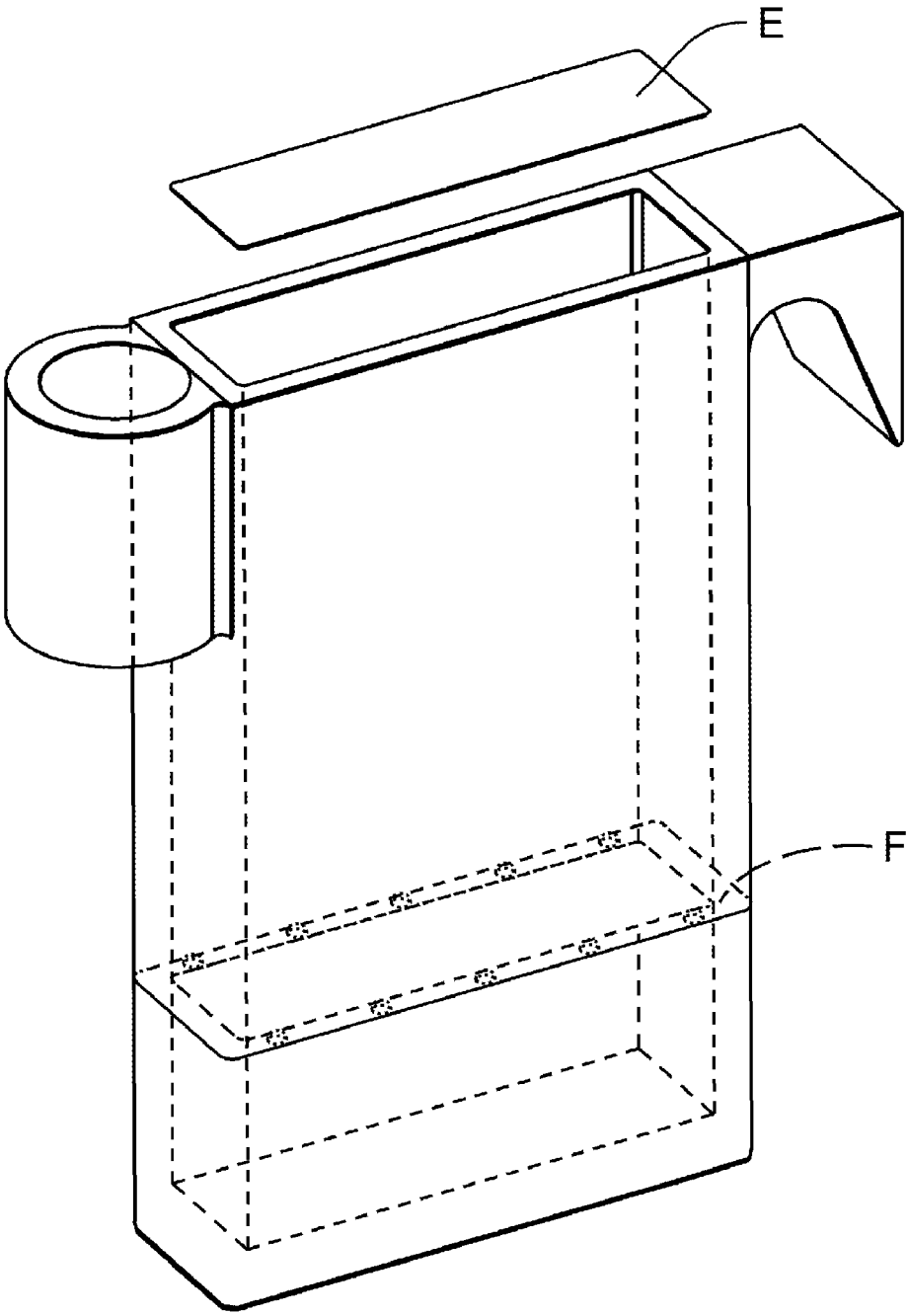
FIG. 7 is a perspective view of a modified releaser having a lid and a water permeable restraint.

A simple technique is employed to accomplish this objective. First, the desired coolant is added into the reservoir up to about half the level of the top portion (as shown in FIG. 6). A lid (E in FIG. 7) is employed to seal the main opening at the top portion. With the lid in place, the modified releaser is vertically inverted (lid resting on the bottom surface inside the refrigerator) and frozen. Once frozen, the modified releaser is vertically inverted back to the upright position, and the lid removed to expose the reservoir (now containing a frozen coolant).

The aim of this technique is to enable the formation of an air space at the covered end of the bottom portion of the reservoir. As a coolant, for example ice, melts in the upright position, the water resulting from the melting ice at the inside surfaces of the releaser flow by gravity to the bottom thereby gradually displacing the air enclosed.

This technique has three functions. The initial cooling stage is prolonged because the water arising from the melting ice flows to the bottom, while the solid ice is suspended in the reservoir due to its shape. This temporary separation prevents the ice from melting at a faster rate due to contact with the relatively warmer water.

The initial cooling phase can be observed through the top opening (D). It is identified by a shrinking volume of ice and bubbling as water displaces air. As the modified releaser becomes a less effective cooling device, water fills the entire bottom portion of the reservoir and a greater volume of water appears in the top portion. This indicates the need to replace the modified releaser.

The third function of this technique is to retain the water at the bottom portion of the modified releaser for a longer period, thereby avoiding spillage as the drinking vessel is tilted. The modified releaser is ideally functional when in contact with beverages filled to the upper sides of drinking vessels. When drinking a beverage directly without a straw, the tilt of the vessel required for this level of beverage will be lesser than if the beverage is almost entirely consumed. By keeping melted ice/water at the bottom of the modified releaser, this technique ensures that there will be no spillage when the beverage is consumed during the initial cooling stage. The modified releaser(s) can be replaced with fresher ones once the initial cooling stage has expired.

For chilling beverages, the pre-cooled modified releaser is attached to the inside of filled vessels. The hook-like feature (A) enables the attachment of modified releasers to a wide variety of drinking vessels with various shapes and wall thicknesses. The hook-like feature (A) forms a notch that can accommodate various wall thicknesses and attach securely to those have a thickness similar to the width of the notch. The ring-like feature (C) restrains the movement of drinking straws being used for beverage consumption. This feature permits the drinker to handle the vessel conveniently with one hand.

The contents of the reservoir can be viewed through the top portion opening. During usage, the melting process is monitored through this opening. This monitoring enables the drinker to effectively decide on when to change a modified releaser. A regular user will be familiar with the different levels of efficiency. Essentially, the cooling function of the modified releaser has been diminished when the reservoir is mostly full of water.

Figure 8:
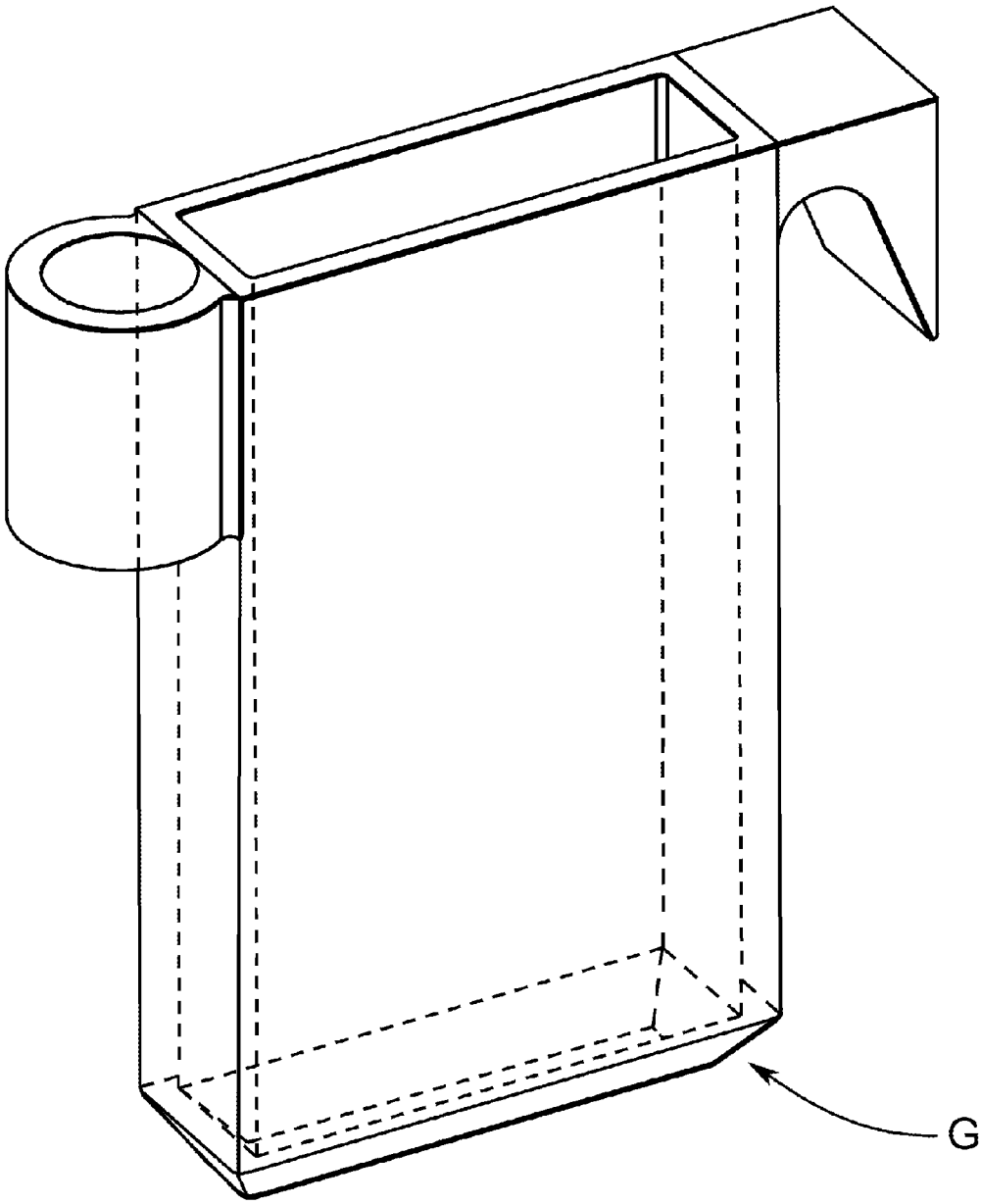
FIG. 8 is a perspective view of a modified releaser having a bottom portion with a decreasing cross section.
Figure 9:
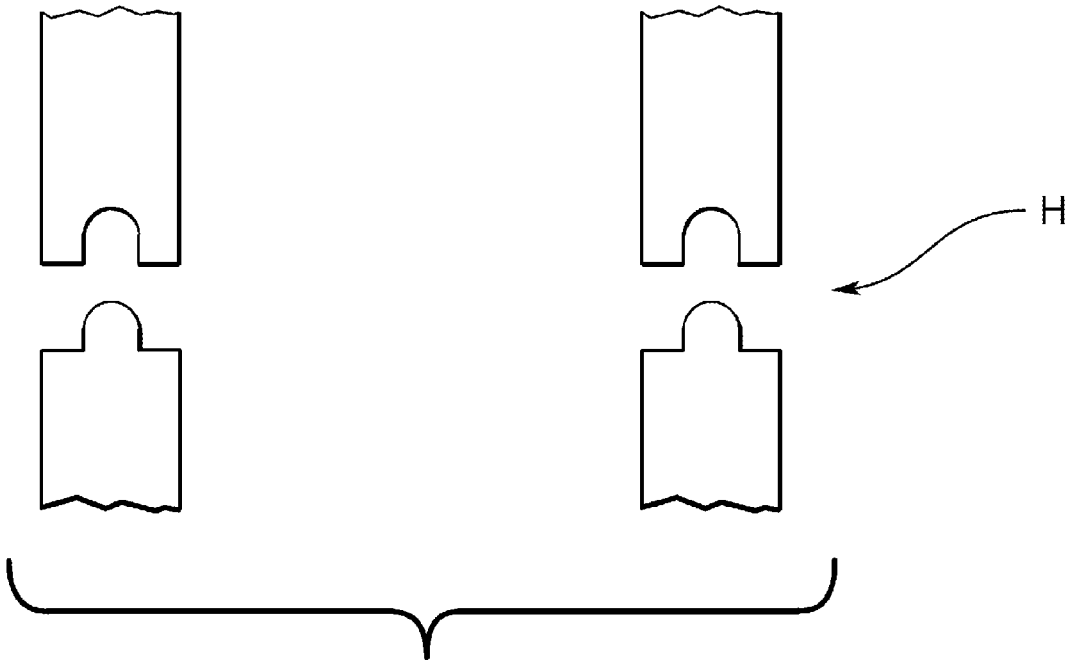
FIG. 9 is a perspective view of a modified releaser having an engagement means for removably securing the top and bottom portions.
Figure 10:
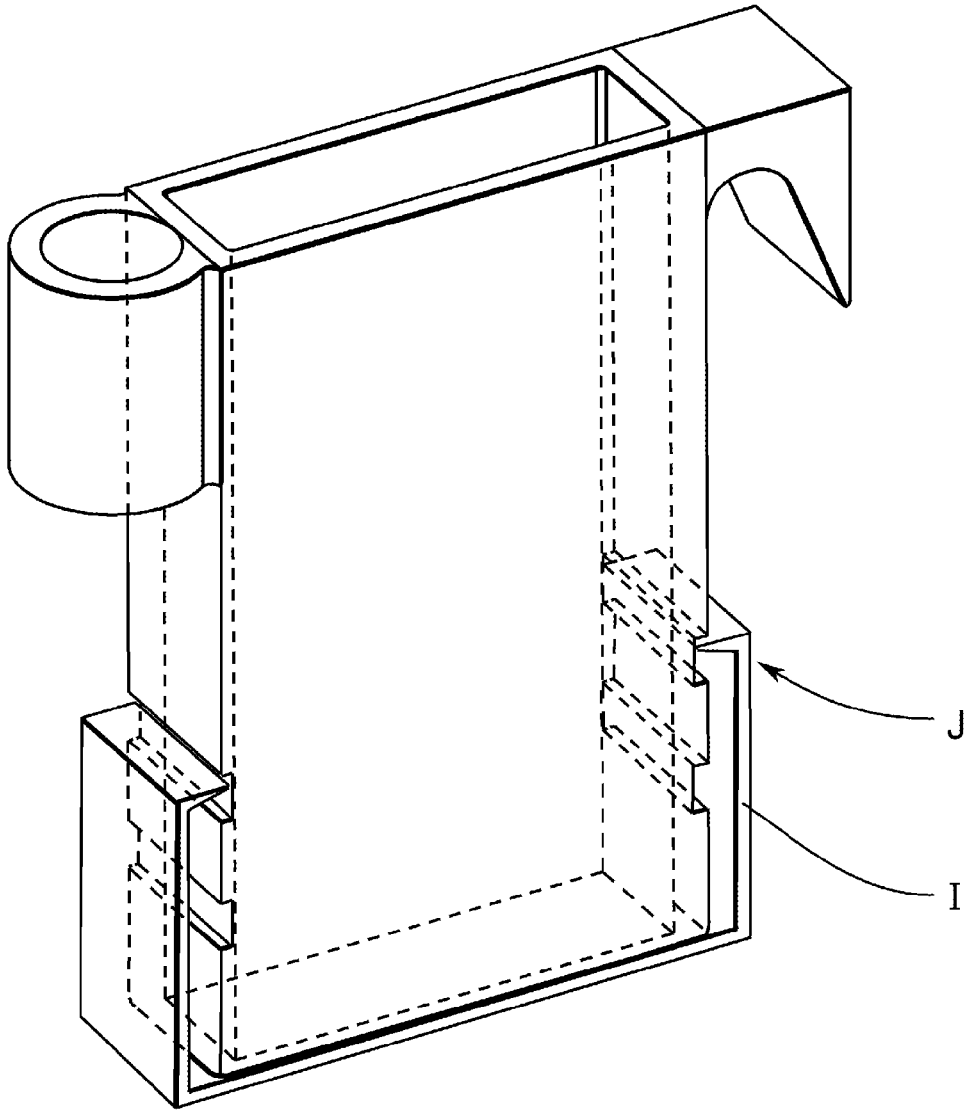
FIG. 10 is a perspective view of a modified releaser having a retractable bottom portion.

The primary modified releaser (FIG. 6) that has been described in this section can be adapted in several ways. Although each adaptation may have a few different features, all the modified releasers function in a similar fashion. These adaptations are in essence different methods of separating ice from water. In the first adaptation (FIG. 7), a water permeable restraint portion (F) is utilized to separate ice from water. Water is frozen on one side of the restraint. The second adaptation (FIG. 8) has the bottom portion ending with a decreasing cross section. The decreasing cross sectional area (G) serves as a water permeable ice restraint. In another adaptation (FIG. 9), the water-filled top portion is detached from (using feature H) the vacant bottom portion prior to freezing. These two portions are secured together (using feature H) once frozen, to cool the beverage in a vessel. The fourth adaptation (FIG. 10) has a retractable bottom portion that can be moved from a first position (J) to a second position (I). The device is filled with water and frozen in the first position. A vacant reservoir volume is created when the retractable bottom portion is moved into the second position.

The foregoing are specific examples of certain aspects of the present invention. Many other embodiments, including modifications and variations thereof, are also possible and will become apparent to those skilled in the art upon a review of the invention as described herein. Accordingly, all suitable modifications, variations and equivalents may be resorted to, and such modifications, variations and equivalents are intended to fall within the scope of the invention as described herein and within the scope of the appended claims.

What is claimed is:

1. A device for modifying the temperature of a beverage in a vessel having a rim, the device comprising a. a hollow rigid body having side walls and top and bottom ends defining an interior chamber for retaining a temperature modifying substance that has been pre-cooled or pre-heated to change the temperature of the beverage when placed in indirect contact with the beverage and b. a cap attached to the top end of the body, the cap having a main portion and an arm extending first laterally away from the body and then downward so that the distance between the downward portion of the arm and the main portion of the cap is less than or equal to the thickness of the rim of the vessel for frictionally and detachably securing the device to the rim of the vessel to retain at least a portion of the body inside the vessel in a fixed position, wherein the temperature modifying substance is in thermal communication with the beverage for exchanging heat with the beverage, and wherein the arm and the main portion of the cap form a notch having an inverted "U" shape having a width corresponding to a minimum rim thickness.

2. The device of claim 1 wherein the arm is made of a flexible material that may be stretched thereby increasing the width of the notch, and wherein the width of the notch with the arm in an unstretched configuration corresponds to the minimum rim thickness and wherein the arm may be stretched to increase the width of the notch to secure the device to vessels having a rim thickness of up to two times the minimum rim thickness.

3. The device of claim 2 wherein the arm may be stretched to increase the width of the notch to secure the device to vessels having a rim thickness of up to 1.5 times the minimum rim thickness.

4. The device of claim 1 wherein the device further comprises a straw holder.

5. The device of claim 4 wherein the straw holder is integrally formed with the cap.

6. The device of claim 1 wherein the temperature modifying substance is permanently sealed within the interior chamber.

7. The device of claim 6 wherein the temperature modifying substance comprises water.

8. The device of claim 6 wherein the temperature modifying substance comprises freezing gel.

9. The device of claim 1 wherein the body is translucent to permit the observation of the state of the temperature modifying substance.

10. The device of claim 1 wherein the body further comprises an opening in the top end for receiving the temperature modifying substance into the chamber and wherein the cap is detachable and sealingly engageable with the opening.

11. The device of claim 10 wherein the cap has a protrusion that extends into the opening thereby sealing the opening when the cap is engaged with the opening.

12. The device of claim 1 wherein the arm is pivotable about an axis extending from the top end to the bottom end of the body for varying the position of the device within a vessel when the device is secured to the rim of the vessel.

13. The device of claim 1 wherein the body is elongated whereby the distance between the top end and bottom end exceeds the width of the body in any plane perpendicular to a central axis extending from the top end to the bottom end of the body.

14. The use of the device of claim 13 wherein material that is denser than the beverage and denser than the device is placed in the chamber for maintaining the bottom end below the top end when the device is placed in the beverage.

15. The device of claim 13 wherein the bottom end is denser than the average density of the device and the bottom end is denser than water for maintaining the bottom end below the top end when the device is placed in the beverage.

16. The device of claim 15 wherein a weight is embedded in the bottom end of the body.

17. The use of the device of claim 15 wherein the device is placed in the beverage without being secured to the rim of the vessel.

18. The device of claim 15 wherein the bottom end is sufficiently denser than the average density of the device to maintain the central axis in a substantially vertical orientation when the device is placed in the beverage.

19. The device of claim 1 further comprising a storage container having a rim whereby a plurality of caps may be secured to the rim of the storage container.

* * * * *